United States Patent [19]

Rutishauser

[11] Patent Number: 4,509,734

[45] Date of Patent: Apr. 9, 1985

[54] MECHANICALLY-OPERATED MAGAZINE-UNLOADING, SHEET-FEEDING MECHANISM FOR SHEET PROCESSING APPARATUS

[76] Inventor: Albert Rutishauser, Rütihofstrasse 38-40, 8713 Uerikon, Switzerland

[21] Appl. No.: 372,373

[22] Filed: Apr. 27, 1982

[30] Foreign Application Priority Data

Jul. 30, 1981 [CH] Switzerland ..... 4941/81

[51] Int. Cl.[3] ..... B65H 7/02

[52] U.S. Cl. ..... 271/10; 271/114; 271/258; 271/110; 400/625; 400/629

[58] Field of Search ..... 271/10, 114, 258, 259, 271/263, 110, 111; 400/624, 625, 629

[56] References Cited

U.S. PATENT DOCUMENTS 2,365,294 12/1944 Sanford ..... 271/258 X
2,813,612 11/1957 Berglund ..... 400/629 X
4,240,622 12/1980 Rutishauser ..... 271/126
4,268,021 5/1981 Rutishauser ..... 271/4
4,362,100 12/1982 Wu ..... 271/259 X

FOREIGN PATENT DOCUMENTS 278394 11/1913 Fed. Rep. of Germany .

*Primary Examiner*—Richard A. Schacher
*Attorney, Agent, or Firm*—Cushman, Darby & Cushman

[57] ABSTRACT

The sheet-processing apparatus has a mechanically-rotated platen at its sheet-processing station, upstream, along the pair of powered transport rolls and upstream of them, at the outlet of the sheet magazine, a powered sheet-abstracting roll. A drive train powers the transport and sheet-abstracting rolls from the platen. A mechanical sensing finger is disposed in the nip of the transport rolls. As the finger is contacted by an end margin of a sheet, the roll-powering drive train is mechanically triggered to be uncoupled. Upon a uniform degree of subsequent rotation of the platen, a return mechanism recouples the drive train and re-cocks the trigger.

11 Claims, 6 Drawing Figures

MECHANICALLY-OPERATED MAGAZINE-UNLOADING, SHEET-FEEDING MECHANISM FOR SHEET PROCESSING APPARATUS

BACKGROUND OF THE INVENTION

The present invention relates to a mechanically-operated magazine-unloading, sheet-feeding mechanism for a sheet processing machine.

The prior art includes prior U.S. patents of A. Rutishauser, U.S. Pat. No. 4,240,622, issued Dec. 23, 1980; T. Rutishauser et al, U.S. Pat. No. 4,268,021, issued May 19, 1981; and a related mechanism is shown in the co-pending U.S. patent application of T. Rutishauser, Ser. No. 234,105, filed Feb. 12, 1981, now U.S. Pat. No. 4,364,551.

There are many instances where a machine that processes sheets of material one by one as the sheets are individually withdrawn from a stack of sheets and fed in a series along a path which goes through a processing station at which something is done to each sheet during its time in the station.

The mechanism of the present invention was developed for a machine for printing on or otherwise providing records on sheets of flexible material such as paper, card-stock or the like. The problem to be solved is how to serially abstract the sheets from a stack in the magazine and forward them one-by-one to and through the station where they are each printed on, recorded on or otherwise processed.

German OS 28 54 695 shows one such mechanism for use on that kind of machine. The prior art mechanism uses an electrically-operated switch that is controlled by a photo-electric cell having a beam which intersects the sheet path at the outlet of the magazine. An electromagnetic clutch is provided for the sheet conveyor, this clutch being electrically controlled by the switch. The disadvantage inherent in this prior art mechanism is that it requires auxiliary electric power to be fed to sites on the machine where everything else is mechanically powered.

SUMMARY OF THE INVENTION

The sheet-processing apparatus has a mechanically-rotated platen at its sheet-processing station, upstream, along the pair of powered transport rolls and upstream of them, at the outlet of the sheet magazine, a powered sheet-abstracting roll. A drive train powers the transport and sheet-abstracting rolls from the platen. A mechanical sensing finger is disposed in the nip of the transport rolls. As the finger is contacted by an end margin of a sheet, the roll-powering drive train is mechanically triggered to be uncoupled. Upon a uniform degree of subsequent rotation of the platen, a return mechanism recouples the drive train and re-cocks the trigger.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
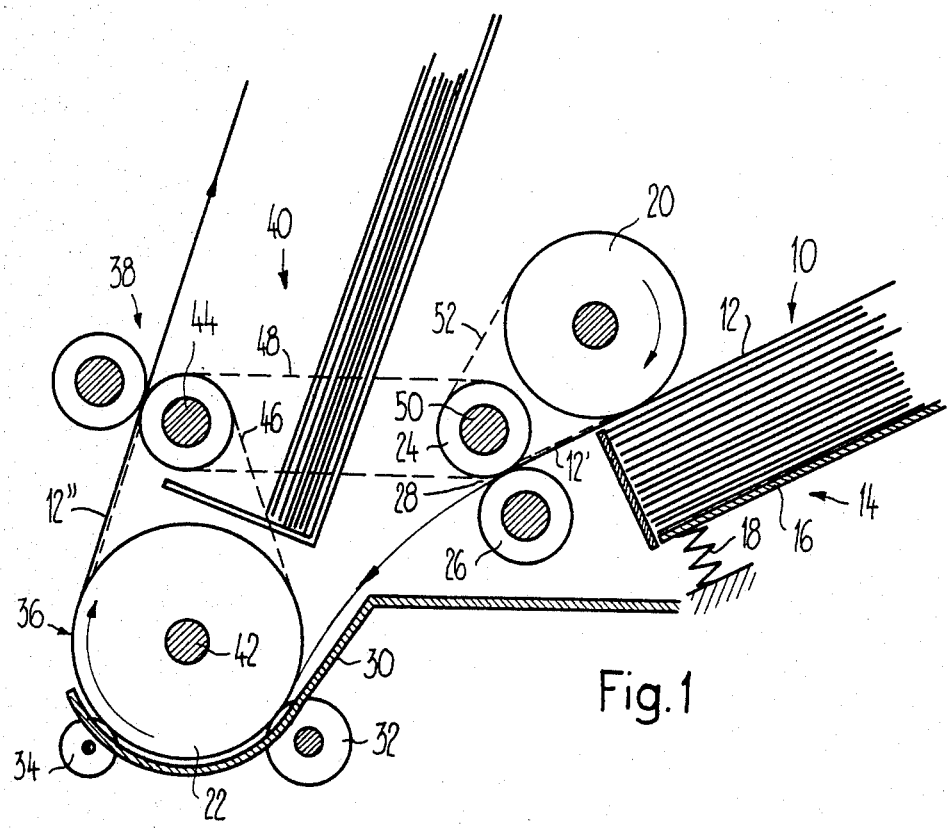
FIG. 1 is a fragmentary longitudinal vertical sectional view of a sheet processing apparatus provided with a mechanically-operated magazine-unloading, sheet-feeding mechanism in accordance with principles of the present invention, some parts being omitted for clarity.

In FIG. 1 there is shown a stack 10 of sheets 12 each of which is intended to be written on. The stack of sheets is accommodated in a magazine 14. The bottom 16 of the magazine 14 is resiliently biased by a locally fixed support spring 18 and tilted in the direction of the conveying roll 20. The (usually two) conveying rolls 20 at a distance from one another on the same axis widthwise of the apparatus serve for pulling-off always the respective topmost sheet 12' in the direction of the driven platen 22.

Between the conveying rolls 20 and the platen 22 a pair of conveying rolls 24 and 26 is disposed, which pair forms between its rolls a clamping gap 28 for the particular sheet 12' that is to be advanced next along the sheet path through the apparatus. For guiding the moved sheet 12' around the platen 22 there is a guide plate 30 as well as pressure rolls 32 and 34. After printing being applied to the sheet 12' (by conventional means not shown) at the sheet-processing station or place 36, the printed sheet 12'' is seized by another pair of conveying rolls 38 and is conveyed into a sheet receiver 40.

The platen 22 is rotationally driven on its shaft 42 by a drive not shown in detail. The shaft 44 of the driven conveying roll of the additional pair 38 of conveying rolls is connected with the shaft 42 of the platen 22 in a torsion-proof manner by a first toothed belt 46. The driven shaft 44 of the additional pair 38 of conveying rolls is connected by way of a releasable coupling and by way of a second toothed belt 48 with the shaft 50 of the conveying roll 24. The driven conveying roll 24 is connected with the conveying rolls 20 by way of a third toothed belt 52. (The three toothed belts 46, 48 and 52 in the illustrated embodiment are shown only symbolically in order to illustrate the driving connections. Naturally on the shown shafts 42, 44 and 50 as well as on the shaft of the conveying roll 20 toothed rolls, not shown, assigned to the toothed belts 46, 48 and 52 have been disposed.)

Between the second toothed belt 48 and the third toothed belt 52 the releasable coupling for the driven conveying roll 24 (FIG. 2) has been disposed. The driven conveying roll 24 and the conveying rolls 20 are interconnected in a torsion-proof manner by the third toothed belt 52.

Figure 2:
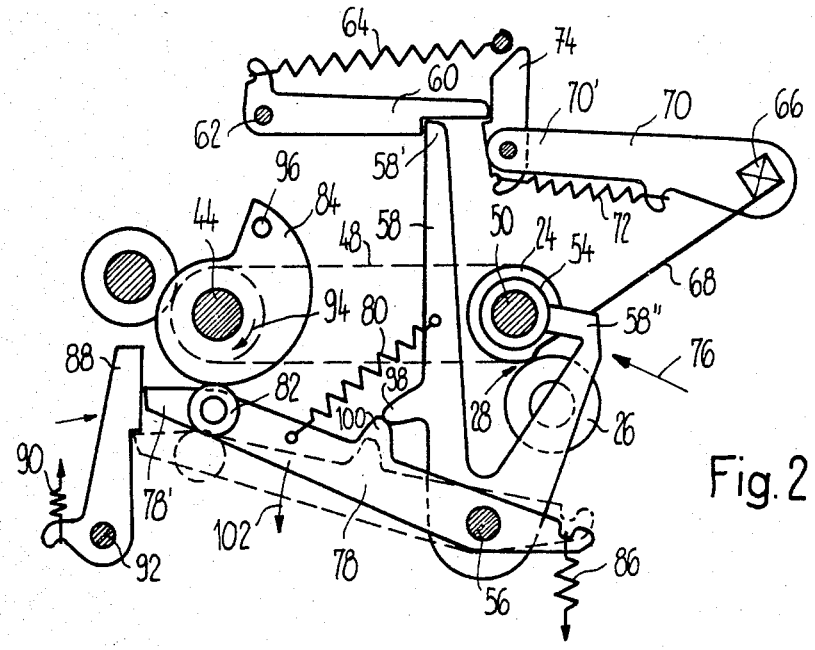
FIG. 2 is a fragmentary sectional view similar to FIG. 1, but with more details of the triggering device and return mechanism being shown, and some parts that are shown in FIG. 1 omitted.

In FIG. 2, the shafts 44 and 50 as well as the second toothed belt 48 are shown again. The second toothed belt 48 is connected in a torsion-proof manner with shaft 50 by way of a toothed roll on said shaft assigned to it. Between the shaft 50 and the driven conveying roller 24, a releasable clutch, 54 is disposed. A coupling arm 58 is disposed swivelably between two positions on the locally fixed peg 56. The angled coupling arm 58 is arrested on its longer end 58′ by a first catch 60 in its first position. The first catch 60 is disposed swivelable around a locally fixed peg 62 and is precocked by a locally fixed, unloaded spring 64.

A sensing lever 68, swivelable around a shaft 66, engages by means of gravity on the line of the clamping gap 28 between the conveying rollers 24 and 26 with the conveying path of the sheet to be conveyed. With the lever 68, a controlling arm 70 is connected by way of the square shaft 66, which arm on its outer end 70′ carries an auxiliary catch 74 resiliently biased by a spring 72. The auxiliary catch 74 cooperates with the first catch 60. The first catch 60, the control arm 70 and the auxiliary catch 74 together form a triggering arrangement connected with the sensing lever 68.

The second end 58″ of the coupling arm 58 serves for the release of the coupling 54 in the direction of the arrow 76. The coupling 54 is kept in engagement by a spring (not shown). Preferably, a toothed coupling is used as coupling 54, because it requires a lesser coupling force than a disc-type coupling. In FIG. 2, the coupling arm 58 is in its first position in which the coupling 54 is engaged, so that rotation of the platen is accompanied by rotation of the sheet conveying rolls.

On the peg 56 on which the coupling arm 58 is mounted, an intermediate member 78 is also mounted swivelably. The coupling arm 58 is resiliently biased in the direction of its second position by a first spring 80 unloaded on the intermediate member 78.

The intermediate member 78 carries, adjacent to its end 78′, a roller 82 which cooperates with a cam disc 84 disposed in a torsion-proof manner on the shaft 44. The intermediate member 78 is resiliently biased in the direction of the cam disc 84 by a second, locally fixed, unloaded spring 86. The second spring 86 exerts a greater torque on the intermediate member 78 than does the first spring 80.

The intermediate member 78 on its end 78′ is shown having a projection cooperating with a second catch 88. The second catch 88 mounted on a peg 92 is resiliently biased by means of a spring 90.

An operating member 96 in the form of a peg is connected with the cam disc 84 driven in the direction of the arrow 94 and is intended for the triggering of the second catch 88.

A projection 98 is disposed on the coupling arm 58 which cooperates with a projection 100 disposed on the intermediate member 78.

The operating mechanism intended for the reengagement of the coupling is shown to include the coupling arm 58 as well as the return mechanism which includes the cam disc 84 and the intermediate member 78.

From FIG. 2, the following functions are apparent:

The intermediate member 78 with its roller 82 is made to follow the cam disc 84 as a result of the force of the spring 86. At the same time, through the cooperation of the two projections 100 and 98, the coupling arm 58 is returned into its first position shown in FIG. 2 and is arrested in said position by the first catch 60. The coupling 54 is engaged in this position of the coupling arm 58. Now, the intermediate member 78 is moved in the direction of the arrow 102 from the arrested coupling arm 58 through the cam disk 84 continuing to rotate in the direction of the arrow 94, and is caught by the second catch 88 counter to the force of the spring 86.

Figure 3:
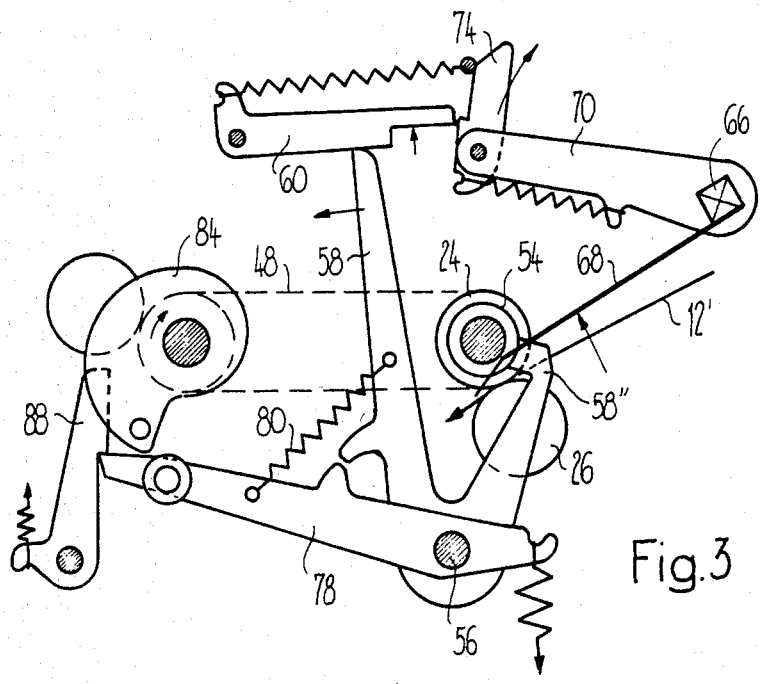
FIG. 3 is a fragmentary sectional view similar to FIG. 2, but at a stage where the feeding of a sheet has just triggered the triggering device.

FIG. 3 shows how the sensing lever 68 is lifted by the next forwardly moved sheet 12′. At the same time, the control arm 70 is swivelled around its shaft 66 in clockwise direction, as a result of which the first catch 60 is lifted by the auxiliary catch 74. The lifting of the first catch 60 has for a consequence that the now unlatched coupling arm 58 bounces back around its peg 56 in a counter clockwise direction into its second position as a result of the force of the first spring 80. At the same time, the coupling 54 is uncoupled. The uncoupling has for a consequence that the pair of conveying rollers 24, 26 and also the conveying roller 20 (FIG. 1) stop rotating, despite the fact that the second toothed belt 48 continues to rotate. Thus, the sheet 12′ that is in the course of being abstracted from the magazine also stops being advanced, while the preceding sheet 12″ (FIG. 1) continues to be moved-on along the path, by the platen 22 and the additional pair 38 of conveying rollers. The temporary stopping of the moved sheet 12′ serves for eventual precise positioning of the sheet 12′ on the platen 22 at a uniform distance upstream from the preceding sheet 12″.

Figure 4:
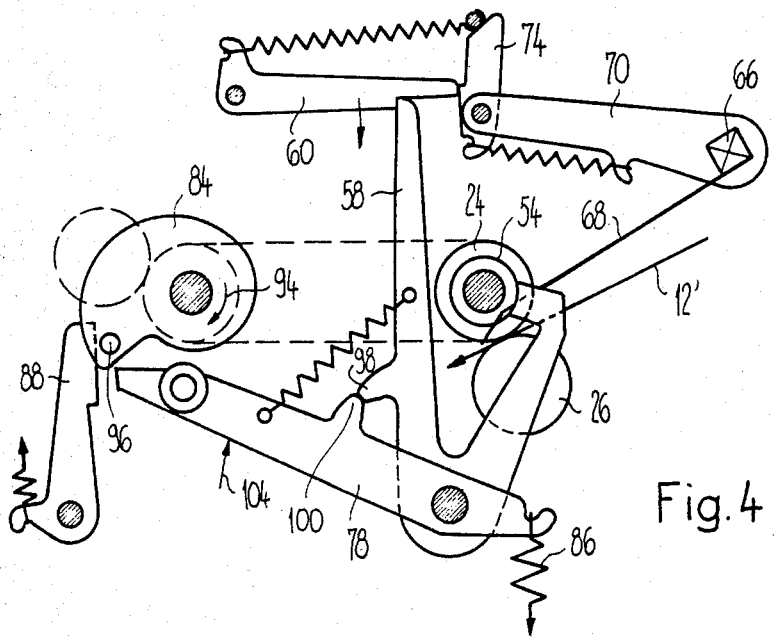
FIG. 4 is a similar fragmentary sectional view at a later stage where the coupling arm has been recaught by the first catch of the triggering mechanism.

From FIG. 4, it is apparent that the cam disc 84 in the meantime has continued to rotate in the direction of the arrow 94, so that the operating member 96 connected with the cam disc 84 has forced away the second catch 88 and with it the intermediate member 78, in the direction of the arrow 104. The intermediate member 78 with its projection 100 was brought by the second spring 86 to fit against the projection 98 of the coupling arm 58, so that said coupling arm 58 at the same time was again returned into its first position. In this first position, it had already been arrested again by the first catch 60, although the sensing lever 68, because of the sheet 12′ passing through, cannot as yet again assume its starting position. The premature catching of the coupling arm 58 in the first catch 60 is made possible by the action of the auxiliary catch 74 disposed on the control arm 70. As soon as the conveyed sheet 12′ has left the sensing lever 68, the latter again drops into its starting position so that by the simultaneous swivelling of the control arm 70, the auxiliary catch 74 again engages below the first catch 60 and assumes the position shown in FIG. 2.

The coupling 54 again becomes engaged at the moment of the return of the coupling arm 58 by the intermediate member 78 released from the catch 88, so that the already partially forwarded sheet 12′ can be fed to the platen 22.

From the embodiment shown by way of example, it becomes clear that the entire power required for the operation of the coupling 54 is derived from the drive (not shown) which produces rotation of the platen 22. Furthermore, it becomes clear from this embodiment given by way of example that three functions are fulfilled by the cam disc 84. According to FIG. 2, the intermediate member 78 is cocked by the cam disc 84 counter to the power of the first spring 80 and counter to the power of the second spring 86. Thus, the coupling arm 58 as a result of the cocked first spring 80, serves as a power storage means, the power of which, according to FIG. 3, is released promptly for uncoupling the coupling 54. The intermediate member 78, cocked by the second spring 86, acts as a second power storage means in order, according to FIG. 4, to return the coupling arm 58 promptly into its first position and thus to engage the coupling 54 again. According to FIG. 4, the third function of the cam disc 84 results through the operating member 96 connected with the cam disc, by which member the intermediate member 78 is released. Therefore, it is possible to disengage the coupling 54 promptly and to engage it again promptly without there being any need for this purpose of an additional power source, such as for example, an electric voltage source. Such an advantage makes the use of the transportation arrangement according to the invention on an automatic recorder considerably easier than where electricity needs to be fed in to run the sheet destacker/feeder.

Figure 5:
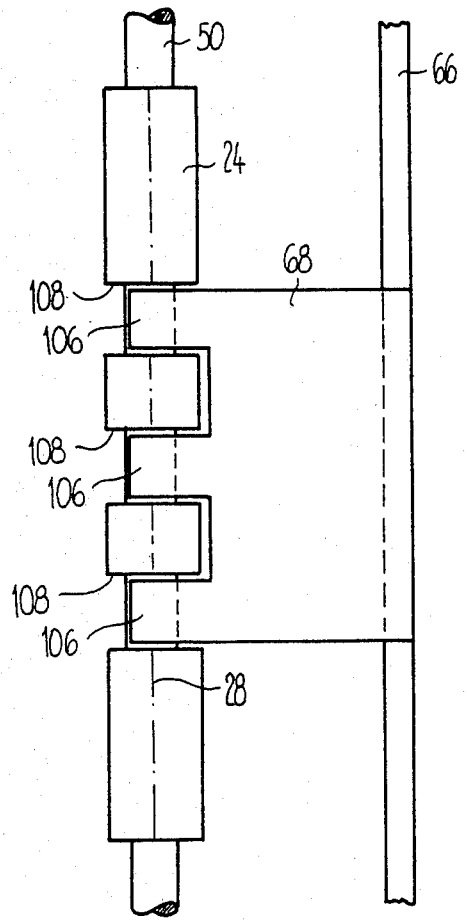
FIG. 5 is a fragmentary bottom plan view showing fingers of the sensing lever projecting into recesses in upper transport roller so as to be located at the clamping gap.

FIG. 5 illustrates that the sensing lever 68 is preferably developed in the shape of a rake and has fingers or prongs 106 at its end. These prongs 106 engage with recesses 108 of the conveying roller 24. The view of FIG. 5 results in the case of an observation of the driven conveying roller 24 according to FIG. 2 on the clamping gap 28, with the conveying roller 26 being removed. The engagement of the sensing lever 68 on the line of the clamping gap 28 results in the least strain of the front edge of the sheet 12' being conveyed, since there hardly is any possibility for missing or bending the sheet.

Figure 6:
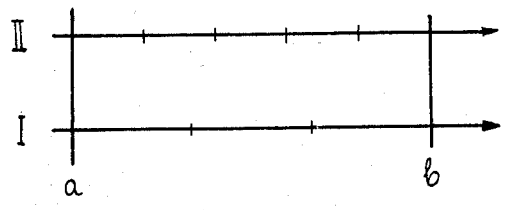
FIG. 6 is a chart of angular position versus time, for the two cam disks of the mechanism, showing by tick-marks on the two chart lines the relationship of the cycling of each cam disk to the other.

In order to guarantee the desired positioning of the sheet 12' on the platen 22 it will be necessary that the operating member 96 cooperating with the second catch 88 becomes effective at a distance which is greater than the length of the conveyed sheet. It is therefore understandable that in the embodiment shown by way of example according to FIG. 1, the arrangement of the first toothed belt 46 is to be understood only symbolically in order to illustrate the coordination of the driving elements. In order to achieve the desired distance during the release of the intermediate member 78 by the second catch 88, a corresponding reduction of the cam plate 84 as against the shaft 44 is therefore required. Instead of such a reduction, it is however also possible to provide an additional driven cam disc (not shown) which is likewise connected torsionally with the platen but with a different reduction than the first cam disc 84, whereby the two cam discs cooperate with the operating member in such a way, that the second catch 88 is operated by both cam discs only at a simultaneous active connection. In FIG. 6 therefore, it is illustrated by way of a diagram the use of two such cam discs, with variable transmission. While the cam disc 1 executes three rotations, the cam disc 2 executes five rotations in order to again assume in the case of position b, the same position as in the case of position a. Now, it is possible to bring about a release only in the case of an agreement of the angular positions of both cam discs, therefore to make use of the simultaneity. However, the construction engineer may also select the construction such that the first two possible releases of the cam disc 1 by the additional cam disc 2 will be prevented by a corresponding arrangement of the lever.

In order to prevent a new stack 10 of sheets 12 from being inserted at a point in the cycle when in consequence of the position of the coupling arm 58 or of the cam disc 84, an uncoupling of the drive train is not possible, it is effective to provide an indicating device (not illustrated) which is operated in connection with the cam disc to provide a corresponding indication to the person who is responsible for reloading the magazine.

It should now be apparent that the Mechanically-Operated Magazine-Unloading, Sheet-Feeding Mechanism For Sheet Processing Apparatus as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A sheet feeding mechanism, comprising:

a driven separating means constructed and arranged to convey a succession of sheets, sheet by sheet, from a stack along a path, towards a sheet processing station;

a sensing lever extending into said path and being constructed and arranged to be displaced by contact with each sheet;

a spring-operated accumulator; a catch arrangement constructed and arranged to releasably block said accumulator; and a resetting device constructed and arranged for loading said accumulator; said spring-operated accumulator being constructed and arranged when blocked to permit sheets to pass along said path towards said sheet processing station, and when unblocked, to interrupt passage of sheets along said path towards said sheet processing station;

a drive means for said sheet processing station;

a coupling disengagably drivingly connecting said drive means with said driven separating means so that when said coupling is engaged, said drive means for said sheet processing station also drives said driven separating means;

said sensing lever being constructed and arranged to operate said catch arrangement and said catch arrangement being connected with said coupling, for disengaging drive means from said driven separating means by unblocking said accumulator, so that conveying of sheets from said stack into said path is interrupted; and said resetting device being operatively connected with said drive means to be rotated by said drive means as said drive means is operated;

a second spring-operated accumulator constructed and arranged for re-engaging said coupling; said resetting device being connected with said second spring-operated accumulator for recharging said second spring-operated accumulator each time after said second spring-operated accumulator has re-engaged said coupling.

2. In apparatus for serially performing a processing step on each sheet of a plurality, each sheet of which in succession is abstracted from a stack in a supply magazine at an outlet of the supply magazine and forwarded along a sheet-feeding path to and past a power-rotated platen that is located at a processing station where said processing step is to be conducted;

where upstream along the sheet-feeding path from the platen there is provided a pair of transport rolls having a sheet-clamping gap defined therebetween, and where upstream along the sheet-feeding path from the pair of transport rolls there is provided a sheet abstracting roll means juxtaposed with the outlet of the sheet supply magazine;

a drive train mechanically interconnecting the platen with both the transport rolls and the sheet abstracting roll means, so as to power both of the latter from the platen;

a releasable coupling interposed in said drive train;

a position sensor having a sensing lever disposed to be activated by contact with each sheet as such sheet begins to be forwarded along said path;

triggering means operatively connecting the releasable coupling with the position sensor, so that as a consequence of a sheet contacting the sensing lever, the triggering means is triggered, and, in turn, temporarily releases the releasable coupling means so that continued rotation of the platen temporarily does not cause corresponding rotation of the transport rolls nor of the sheet abstracting roll means, resulting in a temporary cessation in the feeding of the respective said sheet which has just begun to be forwarded along said path; and return means operatively connected with the platen and with the triggering means and releasable coupling for automatically recoupling the releasable coupling in the drive train and recocking the triggering means upon predetermined further rotation of the platen;

the return means including a coupling arm and a first spring; means mounting the coupling arm for movement between a first position wherein said coupling arm may be arrested by said triggering means and a second position wherein said coupling arm resiliently pre-loads said first spring, and means for connecting the coupling arm with the drive train when the coupling arm is in said second position and the releasable coupling is released.

3. The apparatus of claim 2, wherein:

the triggering means includes a first catch engaged with the sensing lever, said first catch constituting means for arresting said coupling arm when said coupling arm is in said first position.

4. The apparatus of claim 2 or claim 3, wherein:

said return means includes a cam disk, means firmly rotatively connecting the cam disk for rotation with the platen, an intermediate member, means disposing the intermediate member to follow the cam disk and for being brought by rotation of the cam disk into engagement with the coupling arm for returning the coupling arm to said first position thereof.

5. The apparatus of claim 4, further comprising:

a second catch, means disposing the second catch in juxtaposition with said intermediate member for temporarily arresting the intermediate member to temporarily prevent the intermediate member from following the cam disk, said second catch being disposed to be operated to arrest the intermediate member in dependence upon rotation of the platen for returning the coupling arm.

6. The apparatus of claim 5, further including:

a second, locally fixed spring constructed and arranged for preloading the intermediate member against the cam disk;

said first spring, which preloads said coupling arm into said second position of said coupling arm is positioned to unload against said intermediate member.

7. The apparatus of claim 5, wherein:

the cam disk includes an operating member constructed and arranged to release the second catch upon rotation of the cam disk to a predetermined angular disposition.

8. The apparatus of claim 2, wherein:

at least one of said transport rolls is provided with a plurality of axially-spaced radially outwardly opening circumferential grooves; and said sensing lever is constituted by a rake-like member having a plurality of prongs, each one of which is disposed within a respective one of said grooves in said path, within said sheet clamping gap.

9. The apparatus of claim 3, wherein:

the sensing lever is mounted on a second control arm to move the second control arm upon engagement of a sheet with the sensing lever;

the triggering means further includes a second spring-loaded catch, means swivellably disposing the second spring loaded catch on the second control arm, the second spring-loaded catch being arranged to catch the first catch until the second control arm is moved when the sensing lever is engaged by a sheet.

10. The apparatus of claim 2, wherein:

said return means includes spring means constructed and arranged for recoupling said releasable coupling by spring action, and means for reloading said spring means upon uncoupling of said releasable coupling.

11. In apparatus for serially performing a processing step on each sheet of a plurality, each sheet of which in succession is abstracted from a stack in a supply magazine at an outlet of the supply magazine and forwarded along a sheet-feeding path to and past a power-rotated platen that is located at a processing station where said processing step is to be conducted;

where upstream along the sheet-feeding path from the platen there is provided a pair of transport rolls having a sheet-clamping gap defined therebetween, and where upstream along the sheet-feeding path from the pair of transport rolls there is provided a sheet abstracting roll means juxtaposed with the outlet of the sheet supply magazine;

a drive train mechanically interconnecting the platen with both the transport rolls and the sheet abstracting roll means, so as to power both of the latter from the platen;

a releasable coupling interposed in said drive train;

a position sensor having a sensing lever disposed to be activated by contact with each sheet as such sheet begins to be forwarded along said path;

triggering means operatively connecting the releasable coupling with the position sensor, so that as a consequence of a sheet contacting the sensing lever, the triggering means is triggered, and, in turn, temporarily releases the relelasable coupling means so that continued rotation of the platen temporarily does not cause corresponding rotation of the transport rolls nor of the sheet abstracting roll means, resulting in a temporary cessation in the feeding of the respective said sheet which has just begun to be forwarded along said path; and return means operatively connected with the platen and with the triggering means and releasable coupling for automatically recoupling the releasable coupling in the drive train and recocking the triggering means upon predetermined further rotation of the platen;

said return means including spring means constructed and arranged for recoupling said releasable coupling by spring action, and means for reloading said spring means upon uncoupling of said releasable coupling.

* * * * *